United States Patent [19]

Schöttker

[11] 4,327,570

[45] May 4, 1982

[54] APPARATUS FOR BENDING STRIP MATERIAL INTO TOOTHED SHAPE

[75] Inventor: Willi Schöttker, Nordsehl, Fed. Rep. of Germany

[73] Assignee: P.A. Rentrop Hubbert & Wagner, Stadthagen, Fed. Rep. of Germany

[21] Appl. No.: 145,266

[22] Filed: Apr. 25, 1980

[30] Foreign Application Priority Data

Apr. 28, 1979 [DE] Fed. Rep. of Germany ..... 2917365

[51] Int. Cl.[3] ..... B21D 11/04; B21D 5/04

[52] U.S. Cl. ..... 72/320; 72/317; 72/306; 72/322

[58] Field of Search ..... 72/306, 305, 316, 317, 72/319, 320, 322, 323, 386, 379

[56] References Cited

U.S. PATENT DOCUMENTS

| | | | |
|---|---|---|---|
| 317,002 | 5/1885 | Ohl | 72/320 |
| 2,213,648 | 9/1940 | Fraser | 72/386 |
| 2,434,028 | 1/1948 | Wieland | 72/323 |
| 2,699,812 | 1/1955 | McCormack et al. | 72/320 |
| 2,734,552 | 2/1956 | Yonash | 72/322 |
| 3,319,452 | 5/1967 | Rethwish | 72/322 |

*Primary Examiner*—Daniel C. Crane

*Attorney, Agent, or Firm*—Browdy and Neimark

[57] ABSTRACT

For bending strip material into toothed shape, the strip is introduced once into a pair of toothed jaws and a bending member is moved from one end position to another to bend the strip about one end tooth, one end flank of which is exposed. The strip is removed and then similarly bent about another end tooth, in a preferably mirror-image arranged part of the apparatus, in an opposite bending direction, thereby to form a tooth in the strip. The bending steps are repeated as often as necessary.

The invention is particularly applicable to the forming of a toothed band from a plane sheet metal strip.

7 Claims, 5 Drawing Figures

S
S
B
b
1
1a
1b
2
2'
3
4
4'
5
5a
5b'
6
6'
7
7'
7a'
8
8a
8b
8b'
8'
13
13'
14
14'
15
15'
16
16'
17
17'

APPARATUS FOR BENDING STRIP MATERIAL INTO TOOTHED SHAPE

This invention relates to the bending of strip material into toothed shape, and is particularly although not exclusively concerned with producing a toothed band from a plane sheet steel strip.

Toothed bands in the form of a ring are used particularly in planetary gearings, as shown, for example, in German Pat. No. 2 545 681. To produce such toothed bands as these, there is used an apparatus having a fixed part extending in a longitudinal direction with a row of teeth located at the front end corresponding to the form of the teeth of the toothed band, and having a movable part aligned relative to the longitudinal axis of this part with a row of teeth arranged at its front end which are capable of being inserted into the teeth of the fixed part. The width of the movable part and of the fixed part of the apparatus are the same, thereby ensuring mutual engagement of the two front rows of teeth. The plane sheet steel strip is introduced between the rows of teeth of both parts, and the movable part is subsequently moved in the direction of the fixed part until the teeth of the two rows of teeth mesh, thereby forming the toothed band.

In this pressing process, the toothed band is expanded and compressed to an excessive degree relative to the neutral axis in the centre, and more particularly in the areas of the points of the teeth, with the result that the material is overstressed there, so that with prolonged stressing the toothed belt may fracture at these critical points, even within a comparatively short time.

The present invention aims to provide, particularly but not exclusively, an improved apparatus, with which excessive expansion and compression in the critical area of a toothed band can be avoided as it is formed from a strip material, such that the fatigue strength of the band can be increased to a quite considerable degree.

According to one aspect of the present invention, there is provided apparatus for bending strip material into toothed shape, the apparatus comprising:

bending jaw members having sets of teeth which are adapted to engage with one another with a flank of each of two end teeth exposed;

means for moving said jaw members towards and away from one another to bring said sets of teeth into and out of engagement with one another; and at least one bending member movable between two end positions to bend strip material clamped between said jaw members about said two end teeth respectively in turn, in opposite bending directions.

According to another aspect of the present invention, there is provided a method of bending strip material into toothed shape, comprising the steps of:

clamping the strip between toothed bending jaw members such that it is clamped, substantially undeformed, by one flank of one end tooth of which the other flank is exposed;

moving a bending member from one end position to another thereby to bend the strip in one direction about said one end tooth such that the strip abuts both flanks of the tooth;

removing the strip from the jaw members;

inserting the strip between toothed bending jaws such that it is clamped, substantially further undeformed, by one flank of another end tooth of which the other flank is exposed; and moving a bending member from one end position to another thereby to bend the strip in an opposite direction about said other end tooth such that the strip abuts both flanks of the tooth, thereby to form a tooth in said strip.

In one embodiment of the invention, the bending member travels on an arcuate path, and is preferably arranged on a rotating disc which is connected to an actuating handle. Advantageously, the bending member may be formed as a pin which, in one of its end positions, engages in a recess in a fixed part of the bending apparatus. The actuating handle co-operates with an abutment to define the other end position of the bending member.

A toothed band may be produced in a preferred arrangement of the invention in such a way that only one single tooth is formed at a time, quite in contrast to conventional apparatus wherein several teeth are pressed in one single operation. Surprisingly enough, it has been discovered that the expansion and compression in the critical area of the toothed band when the teeth are bent individually is considerably less than in the known pressing process during which several teeth in the toothed band are formed at the same time. Tests have clearly confirmed that the fatigue strength of a preferred toothed band produced in accordance with the invention was approximately three times as great as that of a toothed band pressed by conventional apparatus.

For a better understanding of the invention and to show how the same may be carried into effect, reference will now be made, by way of example, to the accompanying drawings, in which:

FIG. 1 schematically shows a partial top plan view of apparatus for producing a toothed band from steel strip;

Figure 1:
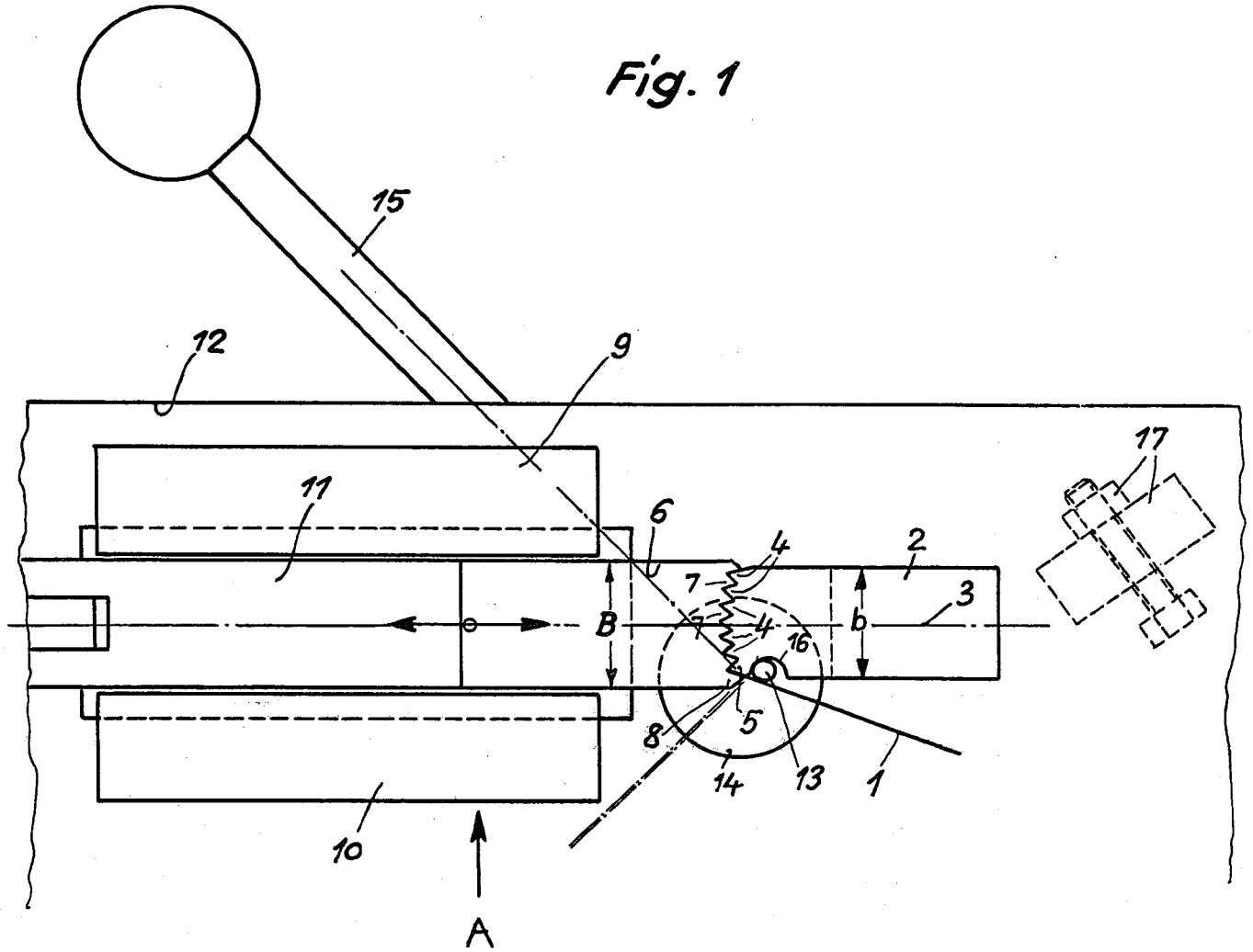
Figure 2:
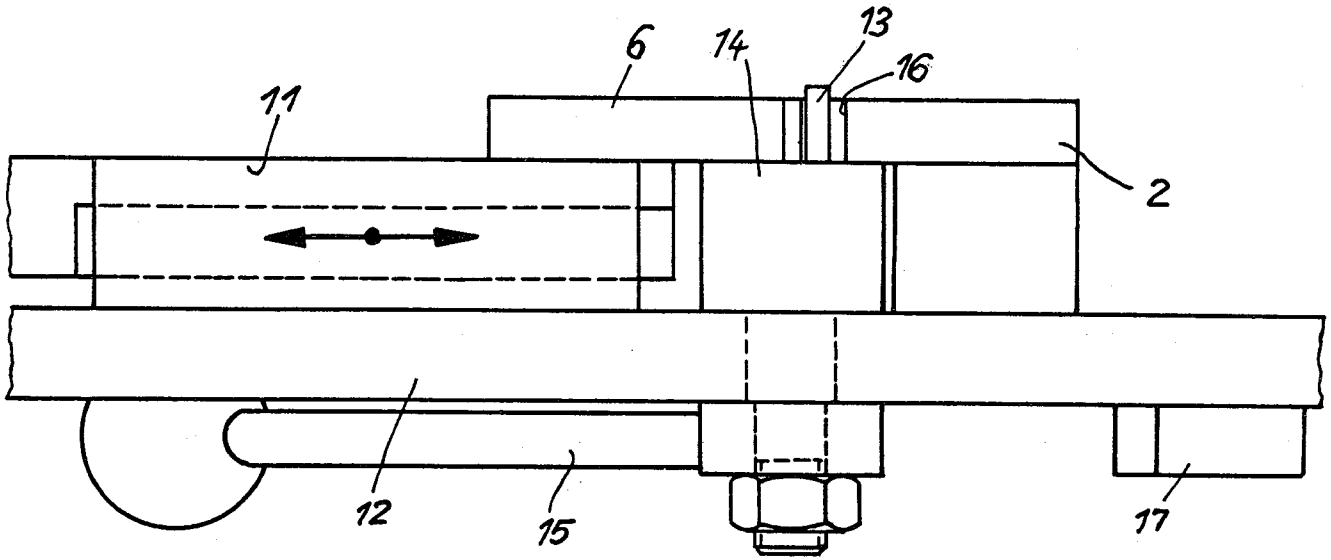
FIG. 2 is a side view of the apparatus of FIG. 1 as viewed in the direction of the arrow A.

FIG. 1 is a partial top plan view of the apparatus for producing a toothed band from a plane sheet steel strip 1. This apparatus has a fixed part 2 extending in a longitudinal direction, its longitudinal axis being indicated by the reference numeral 3. This part 2 has at a front end thereof a row of teeth, the teeth 4,5 of which correspond to the form of the teeth of the toothed band to be prepared. In the embodiment shown in the drawing the points of the teeth 4,5 lie on an arc. The reference numeral 5 denotes one end tooth of the fixed part 2.

A movable part 6 is aligned relative to the longitudinal axis 3, with a row of teeth arranged at a front end thereof, the teeth 7 and 8 of which are adapted to engage in the spaces between the teeth 4,5 of the row of teeth of the fixed part 2. The reference numeral 8 denotes the end teeth of the row of teeth of the movable part 6. The points of the teeth 7,8 also lie on an arc in the same way as those of the teeth 4,5. Thus, the toothed ends of the parts 2 and 6 constitute toothed bending jaw members.

A further fixed part 2' and a movable part 6' are respectively arranged in mirror image fashion about an axis of symmetry S—S (FIG. 3) which is perpendicular to the longitudinal axis 3, the teeth of those two parts 2', 6' being denoted with corresponding reference numerals 4'–8'.

Figures 3, 4, 5:
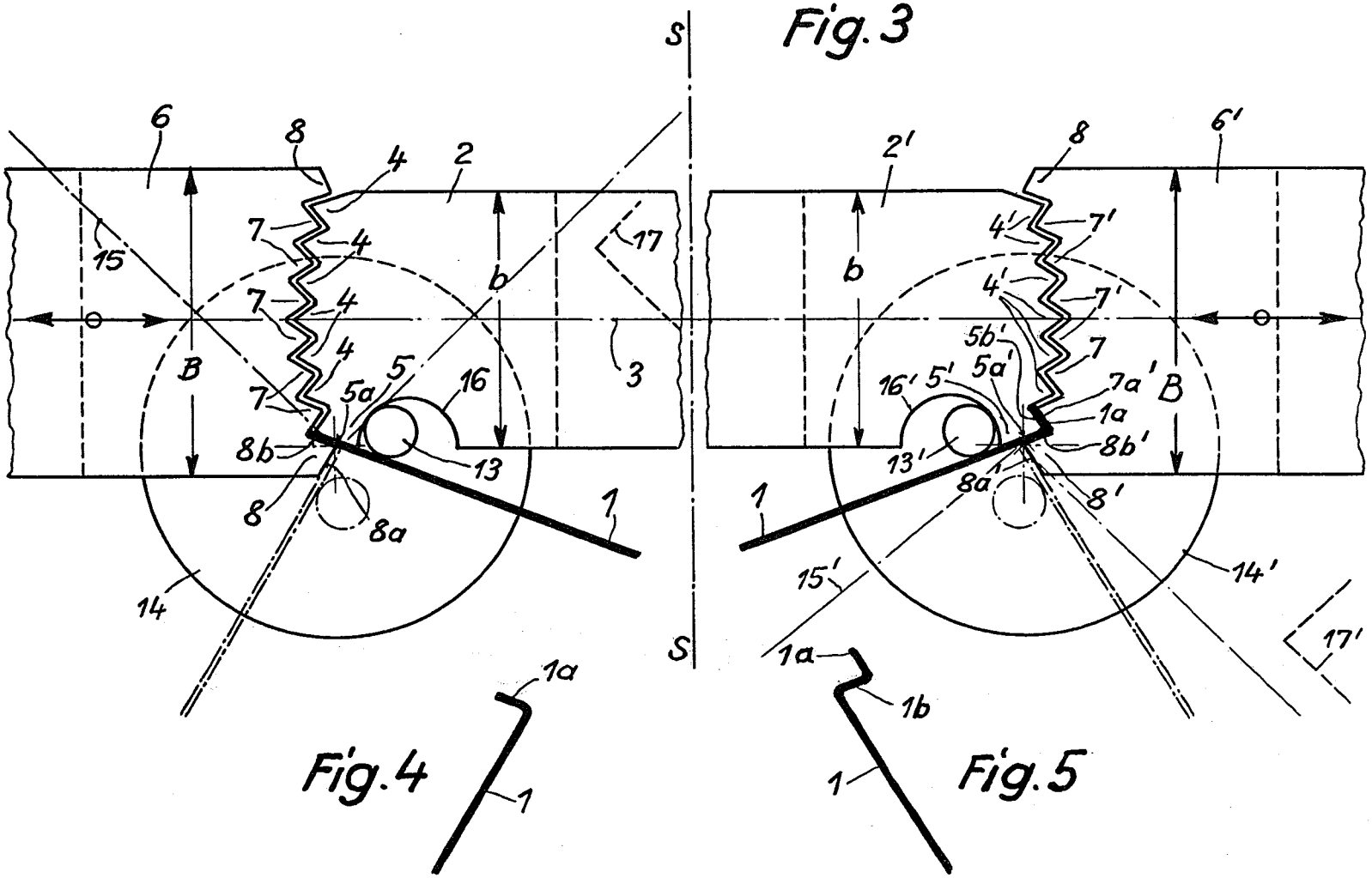
FIG. 3 is a partial top plan view of the apparatus, on an enlarged scale.
FIG. 4 is a top plan view of the steel strip after a first operation.
FIG. 5 is a top plan view of the steel strip after a second operation.

The two movable parts 6, 6' are arranged for movement towards and away from the respective fixed parts 2, 2', and are guided in longitudinal guideways 9, 10 (FIG. 1) which, for reasons of clarity, are not included in FIG. 3. The two movable parts 6, 6' are connected to strips 11 which are connected to a drive (not shown in greater detail) which provides a to- and-fro movement. A dual-action pressure medium-controlled cylinder may be used for the drive, which bears, directly or indirectly, for example by way of a toggle lever mechanism, on the movable parts 6, 6'. The guideways 9, 10 are mounted on a plate 12 to which the corresponding fixed part 2 and 2' respectively is also connected.

The width b of each fixed part 2, 2' is less than the width B of the corresponding movable part 6, 6' by such an amount that the outer flank 8*a* and 8*a*' of each end tooth 8 and 8' of the movable parts 6 and 6' is exposed, as is shown, for example, in FIG. 3 of the drawing. A respective member 13, 13', which is arranged for movement on an arcuate path between two end positions, is arranged in the region of each end tooth 8 and 8', and in the embodiment shown, is formed as a pin which is mounted on a rotating disc 14, 14'. The rotating disc 14, 14' pivots in the plate 12 and is controlled by way of a respective actuating handle 15, 15'. Only the axes of the two actuating handles are denoted in FIG. 3 of the drawing by 15 and 15' respectively.

In one end position, each bending member 13 and 13' engages in a respective recess 16 and 16' in the respective fixed part 2 and 2'.

A respective abutment 17 and 17' co-operates with each actuating handle 15 and 15', to define the other end position of the respective bending member.

The apparatus operates as follows.

Firstly, one end of the sheet steel strip 1 is clamped in the gap between the tooth flank 8*b* which is an inward continuation of the freely projecting tooth flank 8*a*, and the outer tooth flank 5*a* of the end tooth 5, as is shown in the left-hand portion of FIG. 3 of the drawing. One outer end of the sheet steel strip 1 is located in the base between the teeth 7 and 8 of the movable part 6 of the apparatus. The bending member 13 occupies the position shown by a continuous line, to which the sheet steel strip 1 forms a tangent. The actuating handle 15 is subsequently swivelled in a clockwise direction until it rests against the abutment 17. The swivelling motion of the actuating handle 15 causes the bending member 13 likewise to effect a swivelling movement, until it arrives in the position denoted by a broken line. The plane sheet steel strip is thus bent around the point of the tooth 8 during this motion by the bending member 13, which in its final end position, presses the plane sheet strip against the freely projecting tooth flank 8*a*. This final position of the plane sheet steel strip 1 is denoted in FIG. 3 of the drawing by a broken line. The movable part 6 is then disengaged from the fixed part 2 by being displaced to the left in FIG. 3 of the drawing, and the sheet strip 1 is released, now having the form shown in FIG. 4 of the drawing. The bent part is denoted by the reference numeral 1*a*.

The sheet strip 1 thereby formed, without being turned about its longitudinal axis, is now inserted between the two parts 2' and 6', such as is shown in detail in the right-hand portion of FIG. 3. The bent part 1*a* lies between the tooth flank 7*a*' and the tooth flank 5*b*', whilst the continuous plane portion of the sheet steel strip 1 is clamped in the gap between the tooth flank 8*b*', which is an inward continuation of the freely projecting tooth flank 8*a*', and the outer tooth flank 5*a*' of the end tooth 5'. The actuating lever 15', and with it the bending member 13', is then swivelled in a counter-clockwise direction into the position represented in the right-hand portion of FIG. 3 by a broken line, until it comes to rest against the abutment 17'. During this swivelling motion the bending member 13' in turn bends the continuous plane sheet steep strip into the position shown in broken line. The strip 1 then is as shown in FIG. 5 of the drawing, in which an additional bent part 1*b* follows on from the bent part 1*a*.

The sheet steel strip 1 with its form according to FIG. 5 is then clamped again between the two parts 2 and 6, the bent parts 1*a* and 1*b* being inserted into the gap between the teeth 5 and 7 and 4 and 7 respectively. The individual bending processes are then repeated accordingly until a toothed band, which is formed into a toothed ring by welding together the two ends, has been produced from the plane sheet steel strip.

It is an important feature that by bending the individual teeth of the toothed band in stages which are staggered in respect of time, the critical points are relatively only very slightly stressed, with the result that the fatigue strength of the steel band, and hence of the toothed ring produced therefrom, can be increased to a quite considerable degree.

The illustrated apparatus may be varied in several ways. For example, the two fixed parts 2 and 2' may be formed integrally as a single part. Alternatively, the parts referenced 2 and 2' may be made movable, with the parts referenced 6 and 6' fixed. The parts 2, 2' may be made wider than the parts 6, 6', thereby having more teeth, with appropriate modification of the bending members 13, 13'. Although the illustrated apparatus is substantially symmetrical about the axis S—S as regards the members 2, 2' and 6, 6' and 13, 13', this is not absolutely essential. The teeth between which the strip 1 is clamped are advantageously shown in the illustrated apparatus as lying on an arcuate path, to facilitate the production of a toothed band. Nevertheless, they could be disposed on straight lines if desired. Any suitable means for moving the bending members on any suitable path may be employed, instead of the arrangement illustrated.

In an alternative form of the illustrated apparatus, that part of the apparatus to the right of the axis of symmetry S—S may be dispensed with. In its place, a second bending member 13' is provided in preferably mirror-image fashion to the first bending member 13, about the longitudinal axis 3, such that it is positioned at the top of the fixed part 2, as seen in FIG. 3. Suitable modification of the mounting arrangement for the two bending members 13, 13' is then required. Conveniently, the two bending members 13, 13' could be mounted on a common rotatable disc 14 having one or more actuating handles 15.

In another variation, the two bending members 13, 13' may be replaced by a single bending member adapted to be moved between two stations, for carrying out the alternate bending operations.

I claim:

1. Apparatus for bending planar strip material into toothed shape, said apparatus comprising:

two fixed parts extending longitudinally along an axis and each being provided with a respective first bending jaw member;

two movable parts arranged for movement in alignment with the longitudinal axis of the respective said fixed parts and each being provided with a respective second bending jaw member for cooperation with a corresponding one of the first bending jaw members;

sets of teeth provided on the opposing jaw members for engagement with one another with an outer flank of an end tooth of one set exposed;

two bending members, each one corresponding to each pair of cooperating fixed and movable parts and each bending member being movable in order to bend the planar strip material when clamped between two jaw members, to form a toothed shape in the strip material;

said apparatus operating so that each bending member is movable from first end position in which it is engageable with the planar strip material, while the latter is clamped between the corresponding pair of first and second jaw members, to a second end position in which the bending member presses the strip material against said outer flank of said end tooth of said one set;

and in which operation of said apparatus, said fixed parts, movable parts and bending members are mounted on a frame substantially in mirror-image fashion about an axis of symmetry perpendicular to said longitudinal axis.

2. Apparatus according to claim 1, in which the points of each of said sets of teeth is so arranged as to form an arc.

3. Apparatus according to claim 1, in which the width of each fixed part is less than the width of the corresponding movable part, and said second jaw member on the movable part is provided with said one set of teeth having said outer flank of an end tooth exposed.

4. Apparatus according to claim 3, in which said bending members are arranged for movement along a substantially arcuate path.

5. Apparatus according to claim 4, in which each bending member is mounted on a respective rotatable disc which is connected to an actuating handle.

6. Apparatus according to claim 5, in which each bending member is in the form of a pin which, in said first end position, engages in a recess in a respective one of said fixed parts.

7. Apparatus according to claim 6, comprising a respective abutment for each actuating handle, for defining said second end position of the respective bending member.

* * * * *